US007437997B2

(12) United States Patent
Herzog et al.

(10) Patent No.: US 7,437,997 B2
(45) Date of Patent: Oct. 21, 2008

(54) METHOD FOR DELIVERING REPLACEMENT RAIL TIES USING GPS TECHNIQUES

(75) Inventors: Stanley M. Herzog, St. Joseph, MO (US); Ivan E. Bounds, Lake Havasu City, AZ (US); Timothy M. Beers, Turney, MO (US); Steve Pete, Camden Point, MO (US); Ron Schmitz, Clarksdale, MO (US); Stephen L. Bedingfield, Savannah, MO (US); Daniel B. Laughlin, Platte City, MO (US); Joseph A. Kneib, Olathe, KS (US)

(73) Assignee: Herzog Contracting Corp., St. Joseph, MO (US)

( * ) Notice: Subject to any disclaimer, the term of this patent is extended or adjusted under 35 U.S.C. 154(b) by 0 days.

(21) Appl. No.: 12/051,958

(22) Filed: Mar. 20, 2008

(65) Prior Publication Data

US 2008/0163782 A1 Jul. 10, 2008

Related U.S. Application Data

(63) Continuation of application No. 10/829,746, filed on Apr. 22, 2004, now abandoned.

(51) Int. Cl.
*E02B 29/00* (2006.01)

(52) U.S. Cl. ..... 104/6; 104/2; 104/5

(58) Field of Classification Search ..... 104/2, 104/5, 6, 7.1, 9, 10, 15, 12, 17.7, 17.2
See application file for complete search history.

(56) References Cited

U.S. PATENT DOCUMENTS 3,838,649 A 10/1974 Barnard
3,942,448 A 3/1976 Unbehaun et al.
3,971,454 A 7/1976 Waterbury
4,102,066 A 7/1978 Christoff
4,108,076 A 8/1978 Knape
4,114,155 A 9/1978 Raab
4,445,118 A 4/1984 Taylor et al.
4,500,037 A 2/1985 Braitsch et al.
4,751,512 A 6/1988 Longaker
4,781,119 A 11/1988 Davis
4,835,537 A 5/1989 Manion
4,918,690 A 4/1990 Markkula, Jr. et al.
5,129,605 A 7/1992 Burns et al.
5,225,842 A 7/1993 Brown et al.
5,259,337 A 11/1993 Rasmussen
5,284,097 A 2/1994 Peppin et al.
5,323,322 A 6/1994 Mueller et al.
5,359,942 A 11/1994 Ward
5,387,858 A 2/1995 Bender et al.
5,390,125 A 2/1995 Sennott et al.

(Continued)

*Primary Examiner*—Mark T Le
(74) *Attorney, Agent, or Firm*—Husch Blackwell Sanders LLP

(57) ABSTRACT

A method of efficiently delivering replacement railway ties for use in replacing ties that have deteriorated. GPS technology is used to obtain the GPS location of each tie that needs to be replaced. A tie train carrying replacement ties has a GPS monitor so that one or more ties can be unloaded at or near the location of each tie that requires replacement. A tie replacement crew can use a GPS monitor to locate each tie that requires replacement, and the crew can remove those ties and install a nearby replacement tie.

1 Claim, 2 Drawing Sheets

U.S. PATENT DOCUMENTS

| | | | |
|---|---|---|---|
| 5,437,232 | A | 8/1995 | Borowski |
| 5,574,469 | A | 11/1996 | Hsu |
| 5,657,700 | A | 8/1997 | Bounds |
| 5,684,385 | A | 11/1997 | Guyonneau et al. |
| 5,703,468 | A | 12/1997 | Retrillo |
| 5,714,948 | A | 2/1998 | Farmakis et al. |
| 5,737,221 | A | 4/1998 | Newton |
| 5,740,547 | A | 4/1998 | Kull et al. |
| 5,768,128 | A | 6/1998 | Thompson et al. |
| 5,809,448 | A | 9/1998 | Gimenez et al. |
| 5,835,377 | A | 11/1998 | Bush |
| 5,850,620 | A | 12/1998 | Skotnikov et al. |
| 5,867,122 | A | 2/1999 | Zahm et al. |
| 5,904,296 | A | 5/1999 | Doherty et al. |
| 5,907,914 | A | 6/1999 | Theurer |
| 6,027,053 | A | 2/2000 | Anderson et al. |
| 6,073,561 | A | 6/2000 | Theurer et al. |
| 6,092,745 | A | 7/2000 | Seymour et al. |
| 6,161,986 | A | 12/2000 | Smith et al. |
| 6,246,938 | B1 | 6/2001 | Giletta et al. |
| 6,515,249 | B1 | 2/2003 | Valley et al. |
| 6,526,339 | B1 | 2/2003 | Herzog et al. |
| 6,704,626 | B1 | 3/2004 | Herzog et al. |

METHOD FOR DELIVERING REPLACEMENT RAIL TIES USING GPS TECHNIQUES

CROSS-REFERENCE TO RELATED APPLICATIONS

This application is a Continuation of and claims priority to U.S. application Ser. No. 10/829,746 filed Apr. 22, 2004, now abandoned, the entire disclosure of which is incorporated herein by reference to the extent permitted by applicable law.

STATEMENT REGARDING FEDERALLY SPONSORED RESEARCH OR DEVELOPMENT

Not applicable.

TECHNICAL FIELD

This invention relates generally to the replacement of rail ties and more particularly to a method that makes use of GPS techniques to facilitate locating rail ties that need to be replaced, delivering replacement ties to convenient locations in the proper numbers, and removing and replacing the ties.

BACKGROUND OF THE INVENTION

As railway ties become degraded after prolonged use, their condition deteriorates to the point where they need to be replaced because they are no longer able to function adequately. Conventional railway maintenance practice involves maintenance personnel walking the track periodically, inspecting the ties, and marking ties that are degraded to the point where they require replacement. Later, a tie train carrying replacement ties unloads groups of ties at various locations. A tie replacement crew then attempts to locate and remove the marked ties and replace them with the replacement ties.

This conventional practice has numerous shortcomings. The marks that are made to indicate ties that need replacement can wear off or wash off, or they can simply be overlooked by the tie gang even if they are not washed off. If the marks are washed off or overlooked, the ties may be unloaded at the wrong locations, so extra labor is required to move the ties an undue distance along the railway. Worse, defective ties may not be replaced because their markings are washed off or overlooked.

The personnel unloading the ties from the tie train must exercise judgment as to where to unload ties and how many to unload. It is not uncommon for there to be too few or too many replacement ties unloaded at a particular place. Also, it is common for the tie gang to have to move the ties over relatively long distances because the unloading location is too far away from the ties that require replacement. This can significantly increase the labor requirements and the time needed to replace the ties. It can also increase the need for the maintenance personnel to handle heavy ties that are coated with creosote or other chemicals that can create a health hazard.

If too many replacement ties are unloaded, the excess ties need to be picked up and loaded for transport to a place where they can be used. If too few replacement ties are unloaded, some of the ties that need to be replaced are not replaced due to the shortage of unloaded ties. Reporting of the number of ties that have been replaced is typically done by manual procedures that can be inaccurate. As a result, inventory management can suffer and the efficient scheduling of work is more difficult.

SUMMARY OF THE INVENTION

The present invention has, as its principal goal, the provision of a method of rail tie replacement that reduces the labor requirements and allows defective ties to be replaced efficiently, effectively, accurately, and thoroughly.

More particularly, it is an object of the invention to provide a rail tie replacement method that uses GPS technology to allow replacement ties to be delivered to the optimum locations and in the proper numbers for defective ties to be replaced using a minimum amount of manual labor.

Another object of the invention is to provide a method of the character described that assures that all defective ties are properly located and replaced.

Another object of the invention is to provide a method of the character described that accommodates accurate reporting the number of rail ties that are changed.

Yet another object of the invention is to provide a method of the character described that minimizes the handling of rail ties by maintenance personnel. In this regard, the replacement ties are consistently unloaded at or near the locations of the ties they are to replace. This has the advantage of not only reducing the labor but also minimizes the health risks associated with the manual handling of chemically treated rail ties.

A still further object of the invention is to provide a method of the character described in which GPS techniques can be used to assure that ties that are deemed to need replacement are not inadvertently overlooked by the tie replacement crew.

Other and further objects of the invention, together with the features of novelty appurtenant thereto, will appear in the course of the following description.

BRIEF DESCRIPTION OF THE SEVERAL VIEWS OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
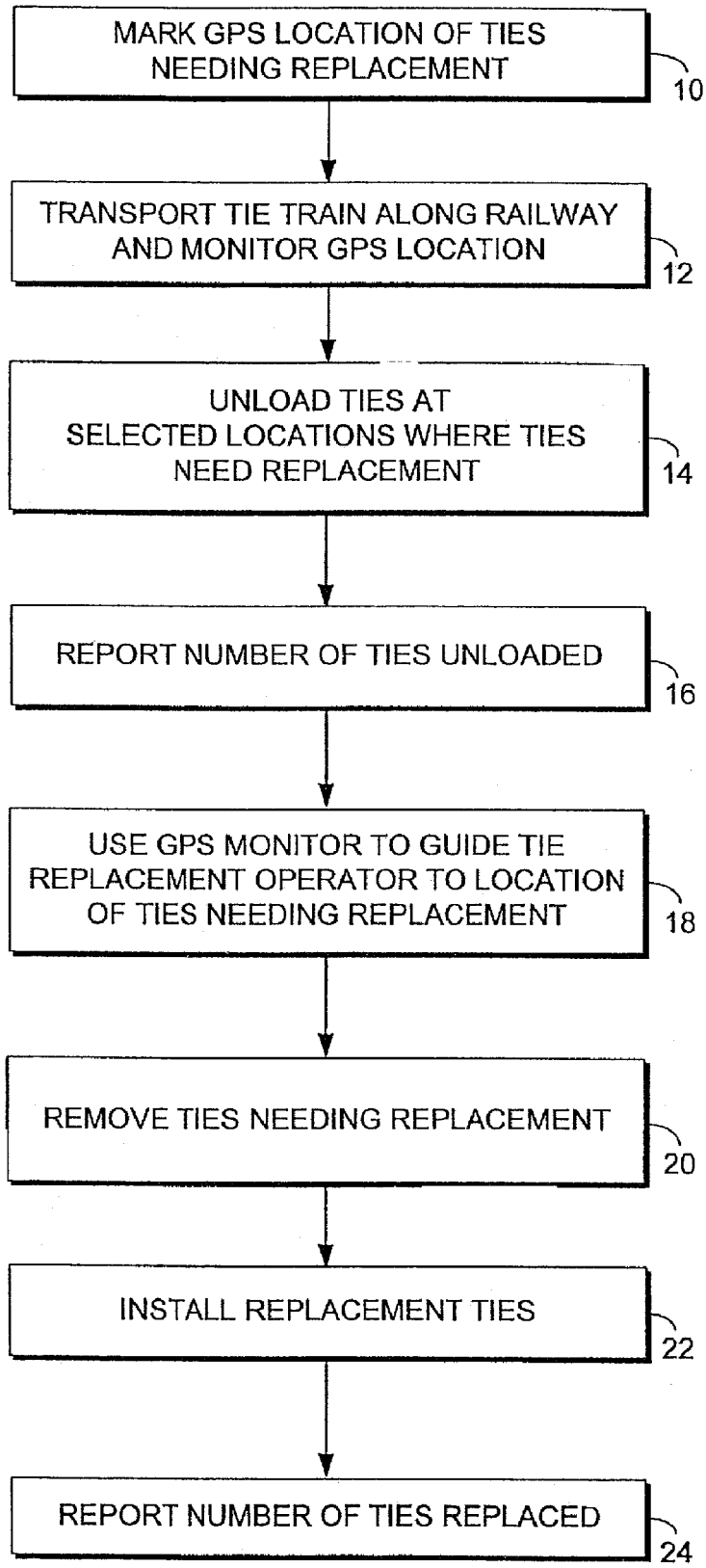
FIG. 1 is a block diagram of the steps included in a method of replacing rail ties carried out in accordance with a preferred embodiment of the present invention.

The present invention is directed to a method that makes use of global positioning system (GPS) technology to facilitate the replacement of railway ties that require replacement. With initial reference to FIG. 1, the preferred embodiment of the invention may include as its first step marking the GPS location of ties that need replacement, as indicated in block 10. Next, a tie train carrying replacement ties is transported along the railway while continuously monitoring the GPS location of the tie train, as indicated in block 12. Preferably, when the GPS locations of the ties are reached, one or more replacement ties are unloaded "on the fly" as the tie train continues its movement. Alternatively, as indicated in block 14, the tie train may be stopped at selected locations which are dependent upon the GPS locations of the ties that need replacement, and a number of the replacement ties (one or more) is unloaded at each of the selected locations. In block 16, a report is generated that includes the number of ties that are unloaded from the tie train. At this point, the required number of ties have been unloaded at or near locations of the ties that need to be replaced.

As indicated in block 18, tie replacement equipment may be transported along the railway while monitoring the GPS location of the replacement equipment. When a location is reached that corresponds with the GPS location of a tie that needs to be replaced, maintenance personnel then proceed in a conventional manner to remove the ties that need to be replaced, as indicated in block 20. Next, as indicated in block 22, the nearby replacement ties are installed in place of the ties that have been removed. Ultimately, the total number of ties replaced is reported as indicated in block 24.

Figure 2:
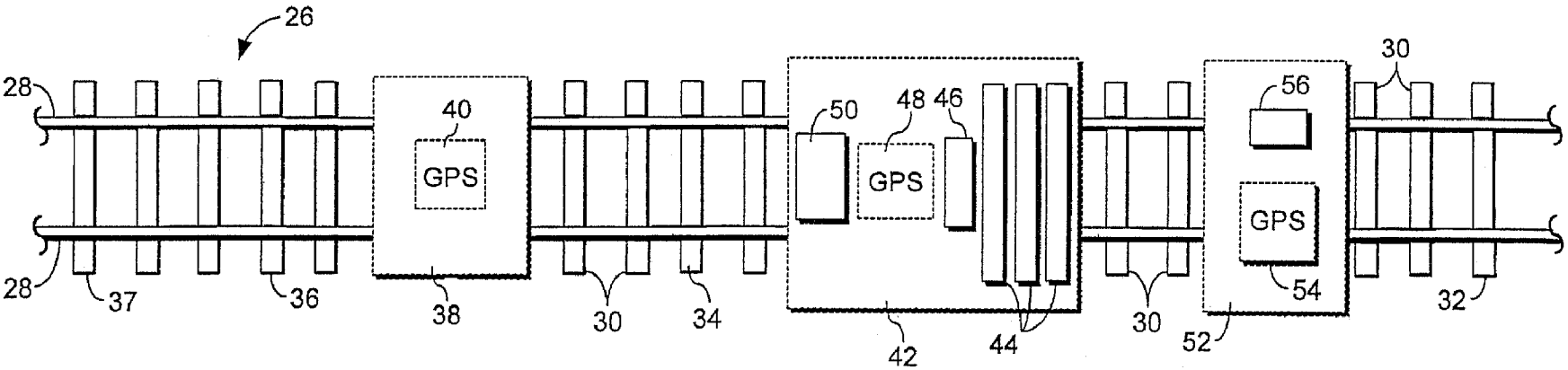
FIG. 2 is a schematic diagram of a railway and apparatus that can be used in the replacement of rail ties in accordance with a preferred embodiment of the present invention.

FIG. 2 is a schematic diagram of a portion of railway 26 that includes a pair of rails 28 supported on spaced apart rail ties 30. By way of example, some of the ties 30 may be defective and in need of replacement, such as the ties identified by numerals 32, 34, 36 and 37.

To carry out the preferred method of the present invention, a survey car 38 can be transported along the railway 26 on the rails 28. The survey car 38 may be equipped with a GPS monitor 40 that continuously provides the GPS location of the car 38. One or more operators of the survey car 38 inspect the ties 30 as the car 38 moves along the rails 28. When an examination of the ties indicates that the tie 32 is defective, an operator enters the GPS location of the defective tie 32 through the GPS monitor 40. In the same manner, the GPS locations of the other defective ties 34, 36 and 37 can be obtained through use of the survey car 38 and the GPS monitor 40. As an alternative to using the survey car 38, maintenance personnel may talk along the railway 26 and use a GPS device such as the GPS monitor 40 to mark the GPS location of each of the defective ties 32, 34, 36 and 37.

In this way, a survey is conducted identifying the GPS location of each railway tie that is defective due to prolonged use or otherwise and has deteriorated to the point where it should be replaced.

With continued reference to FIG. 2, a tie train 42 can then be transported along the railway 26. The tie train 42 carries a number of replacement ties 44 along with a tie unloading machine 46 may be used to unload one or a selected number of the replacement ties 44 if the machine 46 is activated. The tie train 42 is also equipped with a GPS monitor 48 which monitors the GPS location of the tie train. A reporting device 50 may be provided on the tie train 42 in order to generate the reports indicated in blocks 16 and 24 (FIG. 1). Reports generated by the device 50 may be automatically created in electronic form or otherwise and either transmitted by wireless communications to a reporting center or delivered to the reporting center when the tie train 42 has completed its work.

As the tie train 42 is transported along the railway 26, its GPS position is constantly monitored by the GPS device 48. At selected locations along the railway 26, one or more of the replacement ties 44 are unloaded from the tie train 42 by the unloading device 46. For example, when the tie train 42 reaches the location of the first defective tie 32, one replacement tie 44 may be unloaded at a location at or near the location of the defective tie 32, either on the fly or after stopping the tie train. If there are several defective ties in the vicinity of tie 32, tie train 42 may unload a number of ties equal to the number of ties that need to be replaced, with all of these ties unloaded at or near the same location which is at or near the locations of the defective ties.

When the next defective tie 34 is reached, the unloading device 46 is actuated to unload another replacement tie 44 from the tie train. Again, the ties are preferably unloaded on the fly without stopping the tie train, but the train may instead be stopped for the unloading operation as an alternative. When the tie train 42 reaches a location near the ties 36 and 37, it may unload two of the replacement ties 44 at a location between the two ties 36 and 37 which are relatively close together. Neither of the replacement ties in this circumstance would have to be moved very far to reach the location of the defective tie it is to replace.

In this fashion, the tie train 42 is transported along the railway 26, and one or more of the replacement ties 44 is unloaded at a selected location which is dependent upon the location of ties that need to be replaced. The number of replacement ties 44 that are unloaded at any particular location is dependent upon the number of defective ties that are nearby. Optional ways to unload ties under the conditions shown in FIG. 2 are to load one tie near each of the defective ties 32, 34, 36 and 37; to unload one tie at or near each of the relatively isolated defective ties 32 and 34 and unload a pair of ties near the location of the relatively close defective ties 36 and 37; or to unload four ties somewhere near the defective tie 34 and then manually move three of the ties over the distance required to reach the locations of ties 32, 36 and 37. The number of ties unloaded and the locations at which they are unloaded is dependent upon the locations of the defective ties, which is accurately determined through the use of GPS technology.

After the ties have been unloaded, maintenance personnel remove the defective ties and replace them with the replacement ties that have been unloaded at or near the locations of the defective ties. A railcar 52 may be used for this purpose and may be equipped with a GPS device 54 carried on the car 52. Car 52 may carry equipment and/or tools used for the removal of the defective ties and other equipment and/or tools used to install new ties in their place. A reporting device 56 may also be carried on car 52. As the car 52 moves along the track (along with maintenance personnel), the GPS position is monitored with the GPS device 54. When the car 52 reaches the location of the first defective tie 32, the GPS position sensed by device 54 corresponds with the GPS location of the tie 32. The GPS location of tie 32 is thus identified to the maintenance personnel who can then remove tie 32 and install the nearby replacement tie 44 that has been previously unloaded from the tie car 42.

The car 52 then proceeds until its GPS location corresponds to the GPS location of the next defective tie 34. Maintenance personnel are thus guided to the defective tie 34 and can remove it and replace it with the replacement tie 44 that has previously been unloaded at or near the location of tie 34. The car 52 is thereafter guided to the other defective ties 36 and 37 in this fashion, and they are removed and replaced in the same manner.

The maintenance crew can operate without the need for car 52. In this case, they can carry a GPS monitor such as the device 54 to identify the locations of the ties that have been deemed defective.

The reporting device 56 prepares a report indicating and identifying the ties that have been replaced, and the report can either be transmitted by wireless communications or otherwise to a reporting center, or the car 52 can deliver the report to the reporting center. In any case, the number of ties that have been unloaded and the number of ties that have been replaced are reported each day, providing accurate reports as to where the rail tie inventory is located to facilitate scheduling of maintenance work that involves tie replacement.

In this manner, the present invention provides an improved method of delivering replacement rail ties and unloading them at or near the locations of the defective ties which are identified by their GPS locations in order to assure that defective ties are not inadvertently overlooked for any reason. At the same time, the replacement ties are located conveniently near the ties that need to be replaced so that the manual labor and manual handling of the replacement ties is minimized. This is important from the standpoint of holding down the labor costs and the time required, and it also reduces the health risks due to the minimization of the need for manual handling of rail ties that results from the method of the present invention.

The number of ties that are unloaded at a given unloading location can be based on the number of defective ties that are within a predetermined distance of the unloading location. For example, if two or more defective ties are within a selected distance of each other (20 feet as an example), two or more ties may be unloaded at an unloading location at or near one of the defective ties or at a location midway between the defective ties in order to minimize the number of unloading operations without requiring the replacement ties to be manually moved over undue distances.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

The invention claimed is:

1. A method of delivering replacement rail ties along a railway that includes defective ties to be replaced, said method comprising:

selecting a predetermined distance;

using a GPS device to determine a GPS location for each defective tie;

designating as an unloading zone each span along the railway that includes at least two defective ties having GPS locations within said predetermined distance of each other;

determining the distance between the two defective ties in each unloading zone that are farthest apart;

designating as an unloading location the GPS location that is midway between each pair of farthest apart ties in each unloading zone; and unloading at each unloading location a number of replacement ties equal to the number of defective ties in the corresponding unloading zone.

* * * * *

UNITED STATES PATENT AND TRADEMARK OFFICE

CERTIFICATE OF CORRECTION

PATENT NO. : 7,437,997 B2
APPLICATION NO. : 12/051958
DATED : October 21, 2008
INVENTOR(S) : Stanley M. Herzog It is certified that error appears in the above-identified patent and that said Letters Patent is hereby corrected as shown below:

On the Title page:
Item (75) Inventors: delete "Steve Pete" and replace with "Steve Peter"

Signed and Sealed this

Sixth Day of January, 2009

JON W. DUDAS
*Director of the United States Patent and Trademark Office*